United States Patent [19]

Svoboda et al.

[11] Patent Number: 4,634,330

[45] Date of Patent: Jan. 6, 1987

[54] APPARATUS FOR INTRODUCING SOLIDS INTO A SOLIDS UPFLOW VESSEL

[75] Inventors: Daniel Svoboda; Steven Hordinski, both of Denver; Dale R. Severns, Broomfield; Howard W. Hooker, Arvada, all of Colo.

[73] Assignee: Union Oil Company of California, Los Angeles, Calif.

[21] Appl. No.: 194,133

[22] Filed: Oct. 6, 1980

[51] Int. Cl.[4] ..... F23K 3/00

[52] U.S. Cl. ..... 414/198

[58] Field of Search ..... 414/188, 198, 154, 173, 414/180, 187; 105/183, 163, 180; 48/86 R; 202/262; 417/360, 489

[56] References Cited

U.S. PATENT DOCUMENTS

| | | | |
|---|---|---|---|
| 300,385 | 6/1884 | Mathieu . | |
| 968,813 | 8/1910 | Taylor | 105/163 R |
| 2,029,760 | 2/1936 | Derby et al. | 202/108 |
| 2,501,153 | 3/1950 | Berg | 202/6 |
| 2,640,014 | 5/1953 | Berg | 202/6 |
| 2,871,170 | 1/1959 | Bewley et al. | 202/93 |
| 2,875,137 | 2/1959 | Lieffers et al. | 202/6 |
| 2,895,884 | 7/1959 | Switzer | 202/9 |
| 3,908,865 | 9/1975 | Day | 222/135 |
| 4,033,467 | 7/1977 | Bewley et al. . | |
| 4,037,736 | 7/1977 | Pownall et al. . | |
| 4,155,476 | 5/1979 | Lipiec et al. | 105/163 R X |
| 4,249,855 | 2/1981 | Dhonot | 414/198 X |

FOREIGN PATENT DOCUMENTS 144436 8/1902 Fed. Rep. of Germany .

*Primary Examiner*—Douglas C. Butler

*Attorney, Agent, or Firm*—Dean Sandford; Daniel R. Farrell

[57] ABSTRACT

A solids feeder for transporting particulate solids from an elevated solids feed reservoir and introducing the solids upwardly into the bottom of a solids upflow vessel. The feeder includes a horizontally reciprocatable carriage supporting a vertical feed cylinder fitted with a vertically reciprocatable piston. The piston is vertically reciprocated by a hydraulic cylinder suspended from the carriage. The carriage is reciprocated between a first carriage position wherein the feed cylinder is aligned with a feed chute communicating with the feed reservoir and a second carriage position wherein the feed cylinder is aligned with a bottom solids inlet of the upflow vessel. A tram-like suspension system movably supports the carriage from elevated structural rails. Optionally, the structure of the carriage is adapted to controllably vertically yield during the pumping stroke so as to seat the bottom of the piston actuating hydraulic cylinder on a wedge block mounted on the foundation.

12 Claims, 5 Drawing Figures

APPARATUS FOR INTRODUCING SOLIDS INTO A SOLIDS UPFLOW VESSEL

BACKGROUND OF THE INVENTION

1. Field of the Invention

This invention relates to solids handling, and more particularly to apparatus for introducing particulate solids into the bottom of a solids upflow vessel, such as a vertical solids upflow retort used for heat treating oil-producing or oil-containing solids to recover oil and/or gas therefrom.

2. Description of the Prior Art

The problem of transporting particulate solids from a solids feed supply, such as a bin or reservoir of the particulate solids, into the bottom of a solids upflow vessel has been encountered in diverse operations, exemplary of which are the feeding of oil-producing and/or gas-producing solids, such as oil shale, tar sand, bituminous coal, oil-saturated diatomaceous earth, and the like into the bottom of a vertical solids upflow retort for treating the solids to recover oil and/or gas therefrom, and the production of synthesis gas by the reaction of gas containing steam with carbonaceous solids such as coal, coke, and the like.

In these operations, difficulties are encountered in the design and operation of mechanical feed systems because of the nature of the particulate solids being transported, typical solids being abrasive and difficult to handle on the one hand and on the other being friable and tending to abrade, thereby forming large quantities of undesirable fine particles. Feeder devices used to introduce solids into the bottom of an upflow solids bed must move the solids against the weight of the solids bed. Also, it is often the case that the solids must be transported from a storage bin at atmospheric pressure into a solids upflow vessel which operates at a superatmospheric pressure. These factors, coupled with the often gigantic size of the equipment required to obtain the desired solids feed capacity, and the fact that in some applications the feeder device must operate at elevated temperatures and in contact with liquids and/or gases produced in the solids treating process, produce difficult design problems involving large and complex mechanical forces and complicated mechanical loadings that must be adequately provided for in the feeder design.

A number of different apparatus and methods for introducing particulate solids into the bottom of a solids upflow vessel have been proposed. U.S. Pat. Nos. 2,501,153 to Berg, 2,640,014 to Berg, 2,875,137 to Lieffers et al. and 2,895,884 to Switzer disclose solids feeding apparatus and methods in which particulate oil shale is introduced upwardly into the bottom of a vertical retort by means of a piston reciprocating in a feed cylinder that is oscillated between an outlet of a shale feed reservoir and the bottom solids inlet of the retort. While such oscillating feeder apparatus can be satisfactorily employed to introduce particulate solids into a solids upflow vessel, a number of problems and limitations are encountered when using such feeders in large capacity commercial units, such as oil shale retorts having capacities on the order of 10,000 tons of oil shale per day or more. Specifically, oscillating feeder apparatus having these capacities are extremely large and require substantial clearance between the supporting foundation and the bottom of the retort, increasing the height and cost of the retort structure. The clearance between the arcuate seal plates oscillated with the feed cylinder and the bottoms of the feed reservoir and retort must be extremely small, such as about 0.030 to 0.060-inch. Machining of these parts to such close tolerances is very difficult and at best is very costly. Furthermore, it is difficult to completely fill the feed cylinder when it is in the inclined or canted position and, therefore, these oscillating cylinder feeders have a reduced volumetric efficiency.

Various other solids feeder systems have been proposed, exemplary of which are those described in U.S. Pat. Nos. 300,385 to Mathieu, 2,029,760 to Derby et al. and 2,871,170 to Bewley et al. German Patent 144,436 discloses a manually operated device for stoking a boiler with coal which includes a piston-containing cylinder into which the coal is loaded and a lever mechanism for moving the cylinder horizontally into position below the fire box and driving the piston upwardly to force the coal into the bottom of a bed of burning coal. While this device may have application in firing small boilers it is wholly unsuited for feeding particulate solids into the bottom of a large capacity solids upflow vessel, which may be operated at superatmospheric pressure.

U.S. Pat. Nos. 4,033,467 to Bewley et al. and 4,037,736 to Pownall et al. disclose solids feeding apparatus and methods in which particulate solids are introduced upwardly into the bottom of a vertical solids upflow vessel by means of twin pistons reciprocating in twin feed cylinders that are rotated and reciprocated, respectively, between one or more solids feed chutes and the bottom solids inlet of the solids upflow vessel. While such feeders can be satisfactorily employed to introduce particulate solids into a solids upflow vessel at very high rates, the mechanical complexity and enormous size of these feeders results in a very high cost of construction and relatively high operating expense. The Pownall et al. feeder carriage is supported by complex roller bearing-type roller wheel assemblies engaging four structural rails mounted under the carriage, the feed cylinders and the piston actuating hydraulic cylinders. When used for the retorting of oil shale or the like, fine particulate matter settling to the bottom of the feeder housing may cause excessive wear on the rails and roller wheel assemblies. Also, the complex roller wheel assemblies of the Pownall et al. feeder present difficult roller wheel alignment problems. Thus, a need exists for an effective and less mechanically complex apparatus for introducing particulate solids into a solids upflow vessel at high rates which avoids the foregoing problems.

Accordingly, it is a primary object of this invention to provide an improved apparatus for introducing particulate solids upwardly into the bottom of a solids upflow vessel.

Another object of this invention is to provide a mechanically simple and effective solids feeding apparatus having lower construction and operating costs than the prior art apparatus.

Yet another object of this invention is to provide a solids feeding apparatus in which the volume of the feeder housing encasing the apparatus is reduced.

Still another object of this invention is to provide a solids feeding apparatus in which the exposure of the movable weight-supportive elements of the apparatus to particulate fines is reduced so as to minimize wear on such elements.

A further object of this invention is to provide a solids feeding apparatus and method which is relatively simple mechanically so as to reduce the problems of precisely positioning the feeder mechanism.

A still further object of this invention is to provide a solids feeding apparatus and method in which the moving parts thereof are relatively easily accessible for maintenance and repair.

Yet another object of this invention is to provide a solids feeding apparatus and method in which the forces applied to the particulated solids being handled are reduced to a practical minimum.

Additional objects, advantages and features of the invention will become apparent to those skilled in the art from the following description when taken in conjunction with the accompanying drawings.

SUMMARY OF THE INVENTION

Briefly, the invention provides an apparatus for transporting particulate solids from an elevated solids feed reservoir and introducing the solids upwardly through a bottom solids inlet of a solids upflow vessel. The apparatus includes a horizontally reciprocatable carriage movably supported below the solids upflow vessel from elevated structural rails by a tram-like suspension system. Preferably the suspension system includes first and second wheel assemblies engaging first and second elevated structural rails, respectively, on opposite sides of the carriage. A vertical solids feed cylinder fitted with a vertically reciprocatable feed piston is suspended from the carriage. A hydraulic cylinder for actuating the feed piston is supported from the carriage and adapted to vertically reciprocate the feed piston. The carriage is horizontally reciprocated between a first carriage position wherein the feed cylinder is axially aligned with the solids outlet of a feed chute communicating with the feed reservoir and a second carriage position wherein the feed cylinder is axially aligned with the solids inlet of the upflow vessel.

Optionally, a wedge plate may be mounted below the support of the feed piston-actuating hydraulic cylinder in alignment with the solids inlet of the upflow vessel and the structure of the carriage may be designed to controllably yield a short vertical distance so as to seat hydraulic cylinder support on the wedge plate during the pumping stroke of the feed piston.

Preferably, a hydraulic system supplies pressurized hydraulic fluid to hydraulic power cylinders for actuating the feed piston and for reciprocating the carriage. A control system is provided to control the solids feed rate and to synchronize the movements of the feed piston and the carriage.

Where the solids feeder is used to introduce particulate solids, such as oil shale, into the bottom of a solids upflow, fluid downflow retort for thermal treatment of the solids to recover oil and gaseous fractions therefrom, the entire carriage assembly is preferably housed in a substantially fluid-tight housing at the bottom of the retort.

The apparatus of this invention is less mechanically complex than the prior art apparatus capable of introducing solids into an upflow vessel at high rates, such as 10,000 tons per day. Also, the use of the tram-like suspension system and elevated structural rails of this invention substantially reduces the exposure of the weight-supportive moving parts of the feeder to fine particulate matter, thereby avoiding the buildup of a fines deposit on the rails and substantially reducing the fines-related wear on the rails and wheel assemblies. The apparatus is also relatively compact so as to allow a reduction in the volume of any fluid-containing housing enclosing the carriage. Further, the apparatus has relatively few moving parts, thereby reducing the cost of the apparatus as well as making control and maintenance of the apparatus easier.

BRIEF DESCRIPTION OF THE DRAWINGS

The invention will be more readily understood by reference to the drawings, wherein like numerals refer to like elements, and in which.

DETAILED DESCRIPTION OF THE INVENTION

The apparatus of this invention is useful in a variety of solids handling systems for introducing particulate solids upwardly into the bottom of a solids upflow vessel, and is particularly useful for introducing particulate oil shale or other oil-producing or oil-bearing solids upwardly into a vertical solids upflow, fluid downflow retort for thermal treatment of the solids. While the invention will be described with respect to such a retort, the invention is not so limited.

Figure 1:
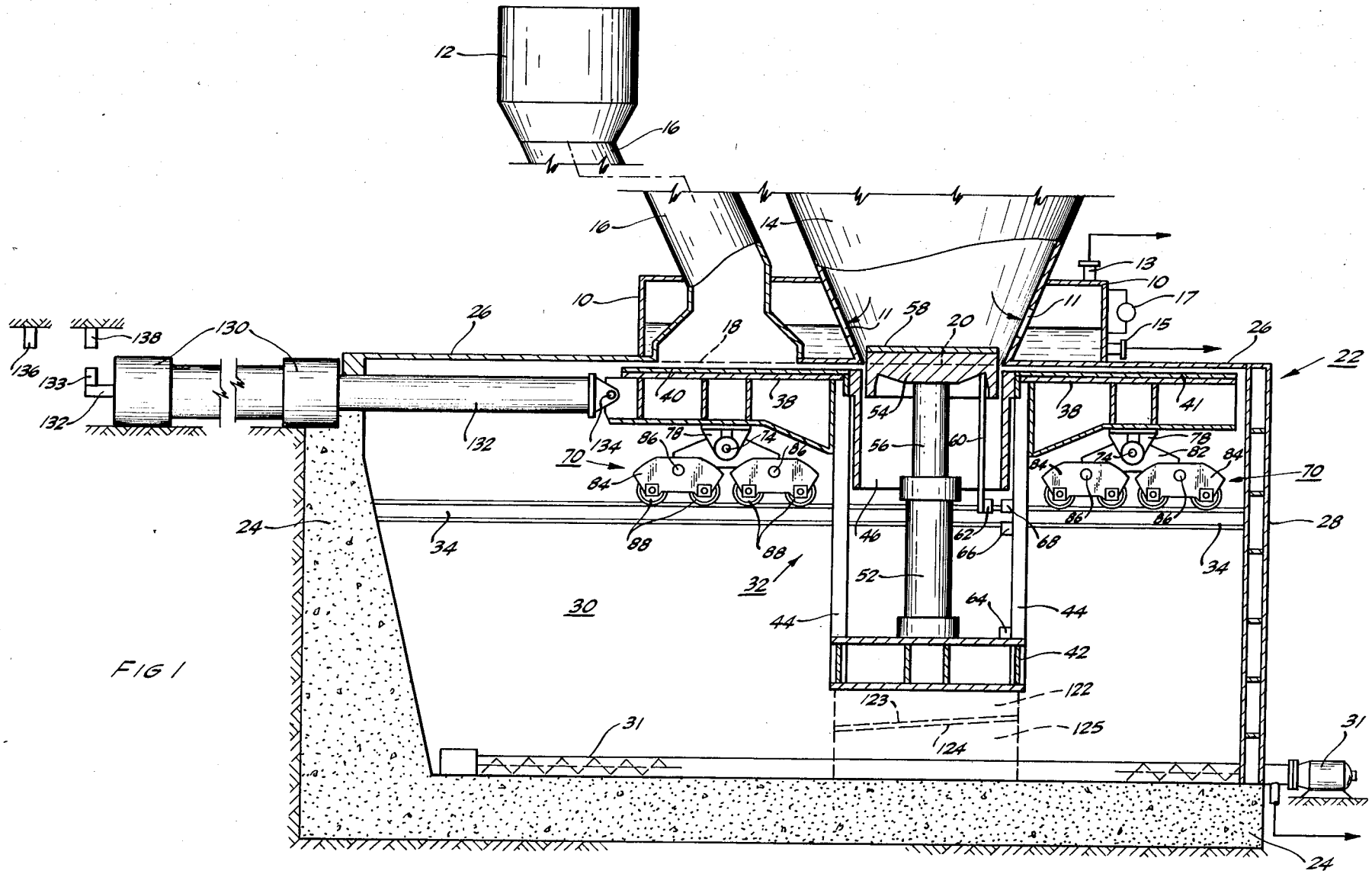
FIG. 1 is an elevational view in vertical cross-section of one embodiment of the solids feeder of this invention.

Referring to FIG. 1, elevated solids feed reservoir 12 mounted adjacent solids upflow vessel 14 communicates through feed chute 16 to bottom solids outlet 18 which has substantially the same diameter, and is in substantially the same horizontal plane, as bottom solids inlet 20 of upflow vessel 14. Upflow vessel 14, only the bottom part of which is shown, is a frustoconical retort vessel adapted for thermal treatment of upwardly flowing solids by direct contact heat exchange with downwardly flowing fluids, such as described in U.S. Pat. Nos. 2,966,446 to Deering, 3,361,644 to Deering, 4,003,797 to Cheadle et al., 4,004,982 to Jennings et al., 4,010,092 to Deering and 4,043,897 to Deering, the disclosures of which are herein incorporated by reference. Disengaging section 10 is a fluid tight compartment connected to the bottom of retort vessel 14 and is in fluid communication with retort vessel 14 by means of slots 11. Fluids flowing downwardly through vessel 14 enter disengaging section 10 and are separated into gaseous and liquid phases. Gas is recovered from disengaging section 10 through gas outlet pipe 13 and may be recycled to the top of retort vessel 14. Liquids are recovered from disengaging section 10 through liquid outlet pipe 15 at a rate controlled by level controller 17.

A substantially fluid-tight feeder housing, shown generally as 22, positioned below retort vessel 14 communicates with feed chute 16 through solids outlet 18 and with retort vessel 14 through solids inlet 20. Housing 22 includes foundation 24, roof 26 and removable door 28, which together define substantially fluid-tight carriage enclosure 30. Preferably, a fines removal system, such as screw conveyor 31 is provided in enclosure 30 for the removal of fine particulate matter which enters enclosure 30 through solids outlet 18 or solids inlet 20 and settles to the bottom of enclosure 30.

As seen in FIGS. 1 through 4, the apparatus of this invention includes a carriage assembly, shown generally as 32, supported from elevated structural rails 33 and 34 by a tram-like suspension system, described more fully herein below. Carriage assembly 32 comprises upper deck 38 which supports substantially horizontal, planar seal plates 40 and 41 immediately below roof 26, solids outlet 18 and solids inlet 20. Vertical feed cylinder 46 is connected to upper deck 38 by means of flanges 48 (FIG. 3) and 50 (FIG. 4) and conventional fastening devices, such as rivets or bolts (not illustrated). The top of feed cylinder 46 is substantially flush with the top of seal plates 40 and 41, and the inside diameter of feed cylinder 46 is preferably substantially the same diameter as or slightly smaller than the diameter of solids inlet 20. Hydraulic cylinder support 42 is suspended from carriage assembly 32 by means of columns 44 and supports hydraulic cylinder 52 in coaxial alignment with and below feed cylinder 46. Hydraulic cylinder 52 is adapted to vertically reciprocate solids feed piston 54 by means of piston actuator shaft 56 between at least two piston positions along the axis of feed cylinder 46. Optionally, wear plate 58 may be attached to the top of feed piston 54.

Structural rails 33 and 34 are mounted in enclosure 30 on opposite sides of feed cylinder 46 and hydraulic cylinder 52 so as to be substantially horizontal and parallel to a horizontal axis passing through the center of solids outlet 18 and solids inlet 20. Structural rails 33 and 34 are elevated a substantial distance above the bottom of hydraulic cylinder support 42 and above the floor of enclosure 30. In this elevated position, structural rails 33 and 34 and the tram-like suspension system will be considerably less subject to excessive wear due to particulate fines in enclosure 30 and to the build-up of a fines deposit on the rails. Preferably, structural rails 33 and 34 are positioned below the plane of solids inlet 20.

Figure 4:
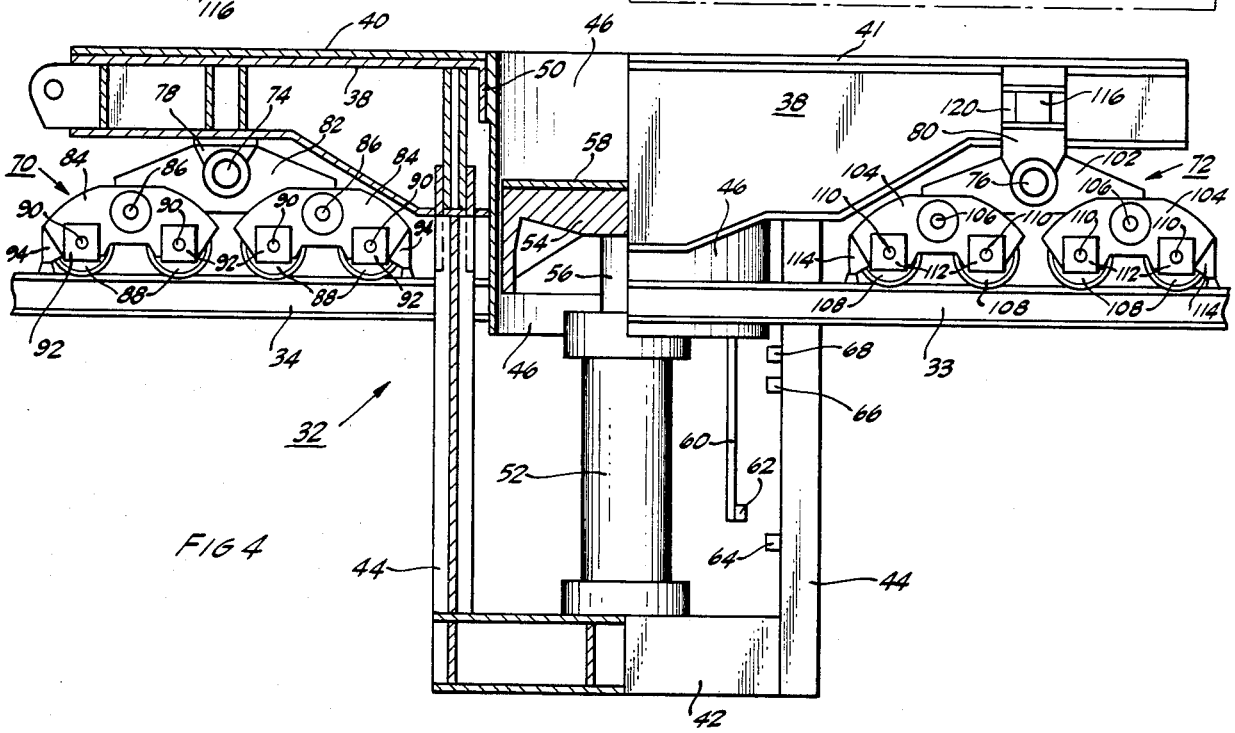
FIG. 4 is an enlarged elevational view in partial cross-section of the carriage taken along line 4—4 of FIG. 3.
Figure 5:
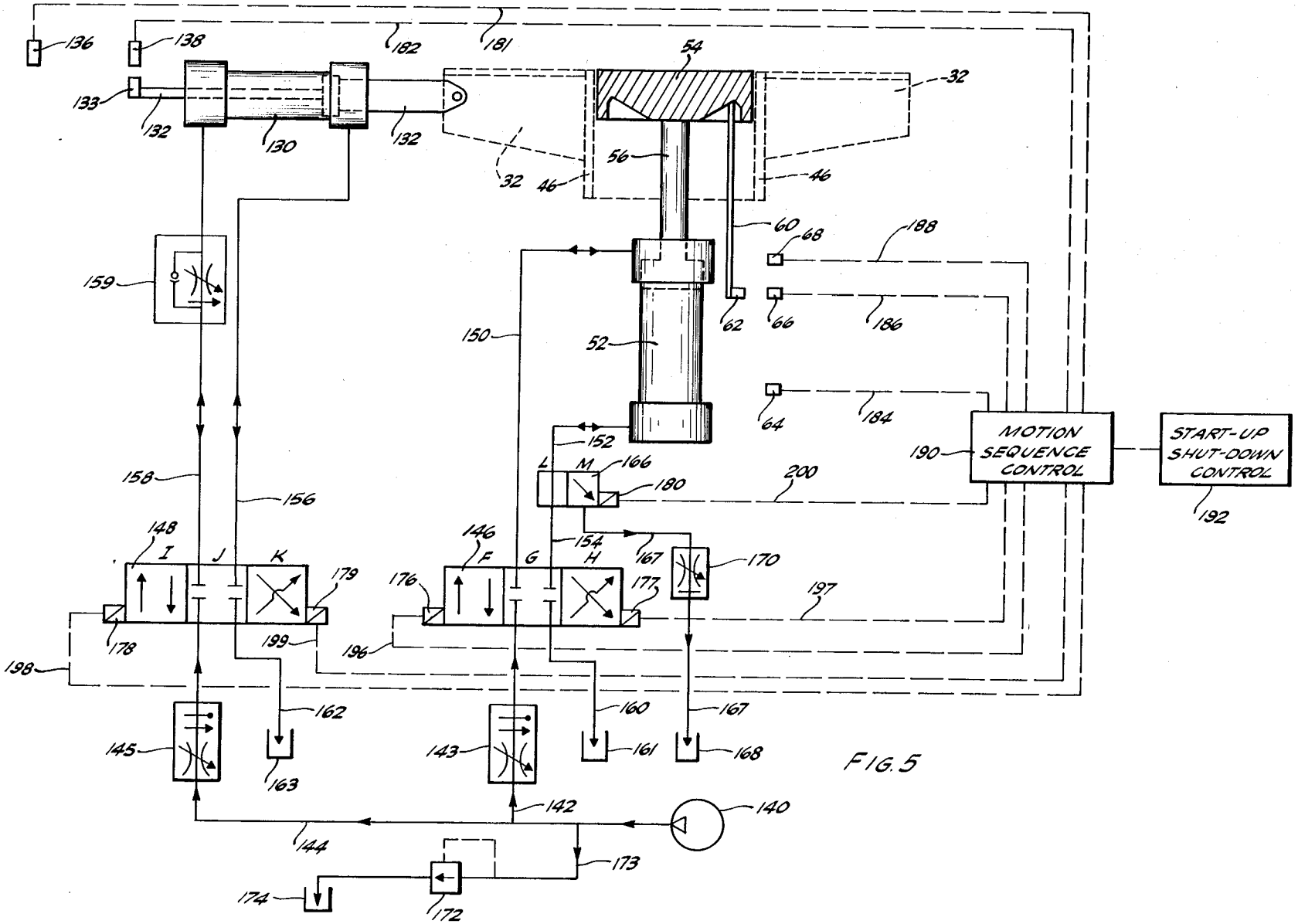
FIG. 5 is a schematic diagram illustrating a preferred embodiment of the hydraulic system and motion sequence control system of this invention.

In the embodiment illustrated in FIGS. 1, 4 and 5, piston position sequence control rod 60 is attached to and extends downwardly from piston 54. Actuator 62 is attached to the lower end of rod 60 and cooperates with detectors 64, 66 and 68 mounted on column 44 to indicate when feed piston 54 occupies each of three preselected piston positions.

Figure 2:
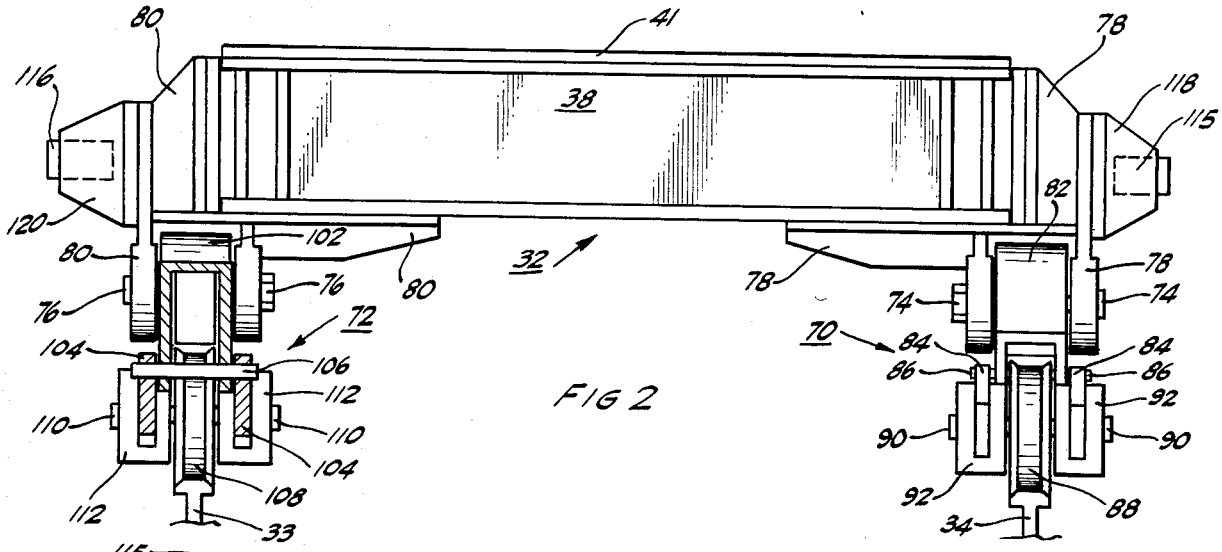
FIG. 2 is an enlarged end view of the horizontally reciprocatable carriage.

As best seen in FIGS. 1, 2 and 4, the tram-like suspension system includes first and second twin wheel assemblies, shown generally as 70 and 72, pivotally connected by means of twin frame equalizer pins 74 and 76, respectively, to twin wheel assembly support brackets 78 and 80, respectively, mounted on opposite sides of and supporting upper deck 38 of carriage assembly 32. Each of wheel assemblies 70 includes frame equalizer yoke 82 pivotally connected to frame equalizer pin 74 so as to be pivotable in a first vertical plane containing structural rail 34; inboard and outboard wheel equalizer brackets 84 pivotally connected by means of twin wheel equalizer pins 86 to opposite ends of frame equalizer yoke 82 so as to be pivotable in the aforesaid first vertical plane; and four carriage support wheels 88 rotatably connected to opposite ends of wheel equalizer brackets 84 by means of axles 90 and journal boxes 92, and adapted to rotatably engage the top of structural rail 34. Optionally, rail wipers 94 may be attached to wheel equalizer brackets 84 as illustrated in FIG. 4 for wiping debris from rail 34.

Similarly, as seen in FIGS. 2 and 4 each of wheel assemblies 72 includes frame equalizer yokes 102 pivotally connected to frame equalizer pin 76 so as to be pivotable in a second vertical plane containing structural rail 33; inboard and outboard wheel equalizer brackets 104 pivotally connected by means of twin wheel equalizer pins 106 to opposite ends of frame equalizer yoke 102 so as to be pivotable in the aforesaid second vertical plane; and four carriage support wheels 108 rotatably connected to opposite ends of wheel equalizer brackets 104 by means of axles 110 and journal boxes 112 and adapted to rotatably engage the top of structural rail 33. Optionally, rail wipers 114 are mounted on wheel equalizer brackets 104 for wiping debris from rail 33. (NOTE: FIG. 2 shows an end view of wheel assembly 70 without rail wiper 94, and a partial cross-section of wheel assembly 72 taken vertically through the outboard wheel equalizer pin 106.)

Figure 3:
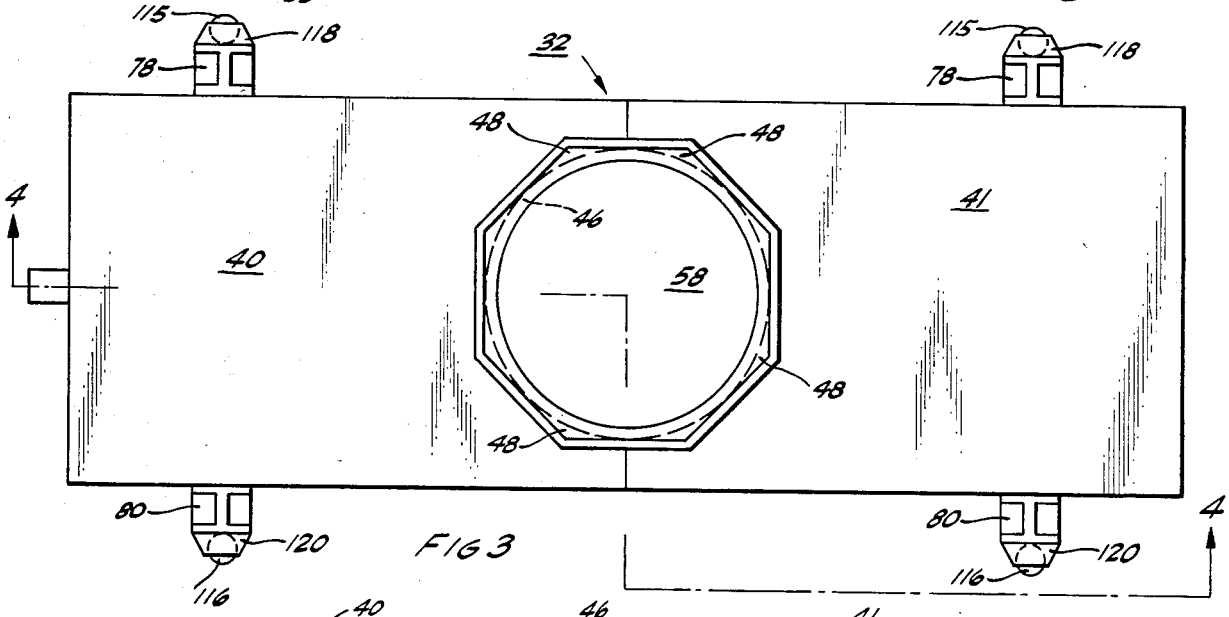
FIG. 3 is an enlarged top view of the carriage.

As best seen in FIGS. 2 through 4, twin lateral rollers 115 and 116 are preferably rotatably mounted in twin roller housings 118 and 120, respectively, attached to twin wheel assembly support brackets 78 and 80, respectively, such that the outermost end of rollers 115 and 116 extend beyond the outermost lateral extension of wheel assemblies 70 and 72, respectively. Rollers 115 and 116 are adapted to engage the side walls of feeder housing 22 and thereby assist in maintaining carriage assembly 32 in proper alignment with structural rails 33 and 34.

As shown in FIG. 1, hydraulic cylinder support 42 may optionally be provided with a downward extension 122 preferably having an inclined planar surface 123 adapted to controllably engage inclined planar surface 124 of wedge block 125 fixedly positioned on foundation 24 in alignment below solids inlet 20. In this embodiment of the apparatus of this invention, the structure of carriage assembly 32 is adapted to controllably yield a short vertical distance during the upward stroke of piston 54 so as to seat hydraulic cylinder support 42 via extension 122 on wedge block 125 thereby transmitting the large forces acting on carriage assembly 32 directly to foundation 24. This controllable yielding can be accomplished by incorporating various springs, shock absorbers or the like into wheel assemblies 70 and 72 in a manner similar to a suspension for automobiles or the like. In one preferred embodiment, carriage assembly 32 is designed to structurally yield without springs or the like due to the very large forces exerted thereon during each pumping stroke of piston 54. In this manner, the vertically acting forces on wheel assemblies 70 and 72 are effectively reduced allowing the use of less expensive, lighter construction designs of wheel assemblies 70 and 72, upper deck 38 and/or structural rails 33 and 34. Alternatively, structural rails 33 and 34 and the structure of carriage assembly 32 may be designed to substantially independently support the entire weight of carriage assembly 32, feed cylinder 46 and hydraulic cylinder 52 throughout the feeder cycle and resist the force generated during the pumping stroke of piston 54.

As seen in FIG. 1, carriage actuating hydraulic cylinder 130 mounted exterior to feeder housing 22 is adapted to horizontally reciprocate carriage assembly 32, by means of carriage actuating shaft 132 extending into feeder housing 22 and attached to upper deck 38 by means of pin joint 134. Hydraulic cylinder 130 reciprocates carriage assembly along rails 33 and 34 between (1) a first carriage position (not illustrated) in which feed cylinder 46 is axially aligned with and immediately below solids outlet 18 and seal plate 41 is immediately below solids inlet 20 in solids-sealing engagement therewith, and (2) a second carriage position (shown in FIG. 1) in which feed cylinder is axially aligned with and immediately below solids inlet 20 and seal plate 40 is immediately below solids outlet 18 in solids-sealing engagement therewith. Carriage position detectors 136 and 138 are mounted exterior to feeder housing 22 and cooperate with actuator 133 mounted on the outboard end of shaft 132 to indicate when carriage assembly 32 occupies the first and second stationary carriage positions, respectively.

Various feeder cycles may be employed with the apparatus of this invention. In each feeder cycle, carriage assembly 32 is initially moved into a first stationary carriage position (not illustrated) in which feed cylinder 46 is immediately below and in axial alignment with solids outlet 18. Piston 54 is retracted a selected distance within feed cylinder 46 to a lowermost first piston position thereby permitting particulate solids to flow by gravity from feed chute 16 through solids outlet 18 into feed cylinder 46. The distance between the top of feed cylinder 46 and the top of piston 54 (or wear-plate 58 if employed) determines the amount of solids charged into feed cylinder 46. While carriage assembly 32 is in the first carriage position, seal plate 41 is in solids sealing engagement with solids inlet 20 so as to prevent the backflow of solids from retort vessel 14. After a selected time for filling feed cylinder 46 with solids, carriage assembly 32 is moved from the first carriage position into a second carriage position in which seal plate 40 is in solids-sealing relationship with solids outlet 18 and feed cylinder 46 is immediately below and in axial alignment with solids inlet 20. Piston 54 is then extended so as to displace the charge of solids from feed cylinder 46 upwardly through solids inlet 20 into retort vessel 14. Subsequently, with piston 54 still in an extended position, carriage assembly 32 is returned to the first carriage position. This feeder cycle may be repeated a plurality of times at a speed selected to charge solids into retort vessel 14 at the desired rate.

While carriage assembly 32 is in the second carriage position, piston 54 may be extended to any one of several piston positions above the lowermost first piston position. Preferably, after full extension of piston 54 to an uppermost second piston position, piston 54 is partially retracted a preselected distance to an intermediate third piston position so as to "relax" the bed of particulate solids in retort vessel 14. It has been discovered that this bed relaxation step substantially reduces the piston-to-solids pressure after relaxation with the result that carriage assembly 32 can be more easily reciprocated between the first and second carriage positions. By proper selection of the distance by which piston 54 is partially retracted, the piston-to-solids pressure after relaxation, as well as the solids loading pressure on seal plate 41, may be reduced to about bin loading pressure, i.e., the steady-state solids loading pressure on the bottom support of a bed of particulate solids free from externally applied forces, or less. Surprisingly, the bed relaxation step also reduces the maximum piston-to-solids pressure during the extension of piston 54, such as by 25 percent or more. These reductions in pressure result in substantial benefits in terms of reduced size and weight of the equipment required, as well as reduced power consumption and minimum fines generation.

The distance by which the piston is retracted during the bed relaxation step is selected in view of, inter alia, the configuration of retort vessel 14, the diameter of piston 54 and the compressibility and other characteristics of the particulate solids. Alternatively, the feeder design can be selected in view of the solids to be transported and the reduced pressures achieved with the bed relaxation step so as to optimize the apparatus design. Preferably, the distance between the second and third piston positions is selected to reduce the piston-to-solids pressure after relaxation to bin loading pressure or less. The distance is typically at least about 0.02 times the diameter of piston 54, preferably between about 0.03 and about 0.2 times the diameter of piston 54. Good results are obtained when piston 54 is partially retracted a distance between about 0.05 and about 0.1 times the diameter of piston 54.

In the preferred feeder cycle using bed relaxation, piston 54 is extended from the lowermost first piston position to an uppermost second piston position in which the top of piston 54 (or the top of wear plate 58 where employed) is a preselected distance between about 0.03 and about 0.2 times the diameter of piston 54 above the top of feed cylinder 46 and within an expanding inlet section of retort vessel 14, as illustrated in FIG. 1. Piston 54 is then partially retracted to an intermediate third piston position in which the top of piston 54 (or the top of wear plate 58 where employed) is substantially flush with the top of feed cylinder 46.

Where bed relaxation is not employed, the preferred feeder cycle involves extending piston 54 upwardly to an uppermost piston position in which the top of piston 54 (or the top of wear plate 58 where employed) is substantially flush with the top of feed cylinder 46.

A preferred embodiment of a hydraulic system for providing the power to vertically reciprocate piston 54 and to horizontally reciprocate carriage 32 is shown in FIG. 5. The hydraulic system includes pump 140 which discharges pressurized hydraulic fluid through conduits 142 and 144 to multiported solenoid valves 146 and 148, respectively. Pressure and temperature compensated flow control valves 143 and 145 control the rate of flow through conduits 142 and 144, respectively. Solenoid valve 146 is connected to the upper end of double acting hydraulic cylinder 52 by conduit 150 and is connected to the lower end of hydraulic cylinder 52 by conduits 152 and 154. Solenoid valve 148 is connected to the inboard end of double acting hydraulic cylinder 130 by conduit 156 and to the outboard end of hydraulic cylinder 130 by conduit 158. Pressure compensated flow control valve 159 controls the rate of flow through conduit 158. Solenoid valves are also connected by conduits 160 and 162 to hydraulic fluid sumps 161 and 163, respectively. Optionally, multiported solenoid valve 166 is connected (1) by conduit 152 to the lower end of hydraulic cylinder 52, (2) by conduit 154 to solenoid valve 146 and (3) by conduit 167 to hydraulic fluid sump 168. Pressure compensated flow control valve 170 controls the rate of flow through conduit 167 to sump 168. Relief valve 172 associated with conduit 173 and sump 174 serves to limit the output pressure of pump 140 to less than a preselected maximum pressure. While sumps 161, 163, 168 and 174 have been illustrated separately, it is understood of course that conventionally all the fluid sumps will be interconnected to form a hydraulic fluid reservoir from which pump 140 draws hydraulic fluid.

Solenoid valves 146 and 148 are multiported solenoid valves capable of simultaneously receiving hydraulic fluid from two conduits and discharging hydraulic fluid to two other conduits, i.e., a total of four fluid conduit connections to each valve. Each of valves 146 and 148 has an internal port mechanism capable of axial movement into one of three operating positions identified as positions F, G and H for valve 146 and positions I, J and K for valve 148. As is conventional, the internal port mechanism is axially shifted in the valve body by means of hydraulic cylinders controlled by solenoid drivers 176 and 177 on valve 146 and solenoid drivers 178 and 179 on valve 148. Similarly, valve 166 has three ports and can be switched between positions L and M by means of solenoid driver 180 to connect conduit 152 to either conduit 154 (position L) or conduit 167 (position M). When solenoid valve 146 is in position F, pressurized hydraulic fluid flows from pump 140 through conduits 142 and 150 to the upper end of hydraulic cylinder 52, while hydraulic fluid simultaneously is displaced from the lower end of hydraulic cylinder 52 either through conduits 152, 154 and 160 to sump 161 (when valve 166 is in position L) or, alternatively, through conduits 152 and 167 to sump 168 (when valve 166 is in position M). Accordingly, when valve 146 is in position F, piston 54 will be retracted. When solenoid valve 146 is in position G, no flow of hydraulic fluid to or from hydraulic cylinder 52 occurs and therefore piston 54 is stationary. When solenoid valve 146 is in position H, pressurized hydraulic fluid flows from pump 140 through conduits 142, 154 and 152 into the lower end of hydraulic cylinder 52, while hydraulic fluid is simultaneously displaced from the upper end of hydraulic cylinder 52 through conduits 150 and 160 to sump 161, thereby extending piston 54.

When solenoid valve 148 is in position K, pressurized hydraulic fluid flows from pump 140 through conduits 144 and 156 into the inboard end of hydraulic cylinder 130, while hydraulic fluid is simultaneously displaced from the outboard end of cylinder 130 through conduits 158 and 162 to sump 163, thereby retracting carriage assembly 32 into a first carriage position in which feed cylinder 46 is in alignment with solids outlet 18. When solenoid valve 148 is in position J, no flow of hydraulic fluid to or from hydraulic cylinder 130 occurs and therefore carriage assembly 32 is stationary. When solenoid valve 148 is in position I, pressurized hydraulic fluid flows from pump 140 through conduits 144 and 158 into the outboard end of hydraulic cylinder 130, while hydraulic fluid is simultaneously displaced from the inboard end of cylinder 130 through conduits 156 and 162 to sump 163, thereby extending carriage assembly into a second carriage position in which feed cylinder 46 is in alignment with solids inlet 20.

Also shown in FIG. 5 is a preferred embodiment of a motion sequence control system for selectively controlling the switching of solenoid valves 146, 148 and 166 so as to synchronize the movements of piston 54 and carriage assembly 32. The position of carriage assembly 32 is detected by limit switches 136 and 138 and communicated by electrical conductors 181 and 182, respectively, to motion sequence controller 190. Similarly, the position of piston 54 is detected by limit switches 64, 66 and 68 and communicated by electrical conductors 184, 186 and 188, respectively, to motion sequence controller 190. The exact locations of limit switches 64, 66 and 68 are matters of choice depending upon, inter alia, the desired stroke length of piston 54, whether or not a bed relaxation step is to be employed and the desired position of piston 54 when fully extended. Such locations will be apparent to those skilled in the art from the following description. Start-up, shut-down controller 192 receives the electrical signals indicative of the positions of carriage assembly 32 and piston 54 from controller 190. The output of controller 192 is connected to controller 190, and the output of controller 190 is communicated to solenoid drivers 176, 177, 178, 179 and 180 by means of electrical conductors 196, 197, 198, 199 and 200, respectively.

The operation of the motion sequence control and hydraulic systems just described will be explained now starting with carriage assembly 32 in the first piston position, such that feed cylinder 46 is in axial alignment below solids outlet 18, and with piston 54 in a fully retracted first piston position. In this starting position, valves 146, 148 and 166 are in valve positions G, J and L, respectively, and no flow of hydraulic fluid occurs. A fresh charge of particulate solids will have flowed by gravity flow through feed chute 16 into feed cylinder 46 as piston 54 was retracted to the first piston position during the previous feeder cycle. Upon reaching this first piston position, limit switch 64 is tripped. In response to the corresponding signal from switch 64, motion sequence controller 190, after a preselected time delay, energizes solenoid drivers 178 and 179 to switch solenoid valve 148 to valve position I, thereby introducing pressurized hydraulic fluid through conduits 144 and 158 into the outboard end of hydraulic cylinder 130 and causing carriage assembly 32 to be moved from the first carriage position into a second carriage position in which feed cylinder is in axial alignment with solids inlet 20 of retort vessel 14. When carriage assembly 32 reaches the second piston position, limit switch 138 is tripped by actuator 133. In response to the signal from switch 138, motion sequence controller deenergizes solenoid drivers 178 and 179 so as to return solenoid valve 148 to valve position J, thereby causing carriage assembly to remain stationary in the second carriage position, and after a selected time delay energizes solenoid drivers 176 and 177 to switch solenoid valve 146 from valve position G to valve position H, thereby introducing pressurized hydraulic fluid through conduits 142, 154 and 152 into the lower end of hydraulic cylinder 52 and causing piston 54 to displace particulate solids from feed cylinder 46 upwardly into retort vessel 14.

In one embodiment, piston 54 is extended until its top surface is substantially flush with the top of feed cylinder 46, at which time limit switch 66 is tripped by actuator 62. In response to the signal from limit switch 66, motion sequence controller 190 deenergizes solenoid drivers 176 and 177 to return solenoid valve 146 to valve position G, thereby holding piston 54 in this extended position, and after a short time delay energizes solenoid drivers 178 and 179 to switch valve 148 to valve position K, thereby causing carriage assembly 32 to return to the first carriage position. When carriage assembly 32 reaches the first carriage position, limit switch 136 will be tripped by actuator 133. In response to the signal from switch 136, motion sequence controller 190 deenergizes solenoid drivers 178 and 179 to return valve 148 to valve position J, thereby holding carriage assembly 32 in the first carriage assembly, and simultaneously energizes solenoid drivers 176 and 177 to switch valve 146 to valve position F, thereby causing piston 54 to be retracted to the first piston position. This just described embodiment of the feeder cycle does not include a bed relaxation step and, of course, limit switch 68, conductor 188, valves 166 and 170, conduit 167 and sump 168 would not be required.

In a preferred embodiment using a bed relaxation step, piston 54 is extended to a second piston position in which its top surface is a preselected distance above the top of feed cylinder 46 and within the expanding inlet section of retort vessel 14 (as illustrated in FIG. 1), at which time limit switch 68 is tripped by actuator 62. In response to the signal from limit switch 68, motion sequence controller 190, energizes solenoid drivers 176 and 177 to switch solenoid valve from valve position H to valve position F and simultaneously energizes solenoid driver 180 to switch valve 166 to valve position M, thereby retracting piston 54 at a selected relatively slow rate controlled by valve 170. When piston 54 reaches an intermediate third piston position in which its top surface is substantially flush with the top of feed cylinder 46 (as illustrated in FIG. 5), limit switch 66 will be tripped by actuator 62. In response to the signal from limit switch 66, motion sequence controller 190 deenergizes solenoid drivers 176, 177 and 180 to return solenoid valves 146 and 166 to valve positions G and L, respectively, thereby holding piston 54 in this third piston position, and after a short time delay energizes solenoid drivers 178 and 179 to switch solenoid valve 148 to valve position K, thereby causing carriage assembly 32 to be returned to the first carriage position. When carriage assembly 32 reaches the first carriage position, limit switch 136 will be tripped by actuator 133. In response to the signal from switch 136, motion sequence controller deenergizes solenoid drivers 178 and 179 to return valve 148 to valve position J, thereby holding carriage assembly 32 in the first piston position, and simultaneously energizes solenoid drivers 176 and 177 to switch solenoid valve 146 to valve position F, thereby causing piston 54 to be retracted.

While particular embodiments of the invention have been described, it will be understood, of course, that the invention is not limited thereto since many obvious modifications can be made, and it is intended to include any such modification as will fall within the scope of the appended claims.

Having now described the invention, we claim:

1. An apparatus for introducing particulate solids upwardly into a solids upflow vessel having a bottom solids inlet, which comprises:

a solids feed chute mounted adjacent to said solids upflow vessel and communicating with an elevated solids feed reservoir, said feed chute terminating in a solids outlet in substantially the same horizontal plane as said bottom solids inlet and spaced from said bottom solids inlet along a first axis;

a carriage positioned below said solids upflow vessel;

first and second substantially horizontal structural rails mounted parallel to said first axis and on opposite sides of said carriage;

tram-like suspension means for horizontally movably and substantially independently supporting said carriage from said first and second rails;

carriage actuator means for horizontally reciprocating said carriage between first and second stationary carriage positions along a substantially horizontal second axis parallel to said first axis;

a vertical solids feed cylinder mounted on said carriage such that said feed cylinder is axially aligned with and immediately below said solids outlet when said carriage is in said first carriage position and said feed cylinder is axially aligned with and immediately below said bottom solids inlet when said carriage is in said second carriage position;

a solids feed piston movably mounted in said solids feed cylinder;

feed piston actuating means supported from said carriage for vertically reciprocating said solids feed piston between at least two piston positions along the axis of said feed cylinder;

solids sealing means for sealing said solids outlet and said bottom solids inlet when said feed cylinder is not axially aligned therewith;

control means for synchronizing the movements of said carriage and said feed piston;

a foundation positioned below said carriage;

a wedge plate fixedly positioned upon said foundation;

wherein said carriage is adapted with a downwardly facing engaging surface positioned so as to be immediately above said wedge plate during the upward stroke of said feed piston and wherein at least a portion of the structure of said apparatus is adapted to controllably yield in the vertical direction under a preselected force during said upward stroke of said feed piston thereby engaging said engaging surface with said wedge plate and transmitting any force in excess of said preselected force directly to said foundation.

2. The apparatus defined in claim 1, wherein said carriage and said first and second rails are encased in a substantially fluid-tight carriage housing below said solids upflow vessel which communicates with said feed chute through said solids outlet and with said solids upflow vessel through said bottom solids inlet, and wherein said first and second structural rails are mounted a substantial distance above the internal floor of said carriage housing.

3. The apparatus defined in claim 1 wherein said feed piston actuating means is adapted to reciprocate said feed piston among a first piston position in which the top of said feed piston is a preselected substantial distance below the top of said feed cylinder, a second piston position in which the top of said feed piston is a preselected distance above the top of said feed cylinder, and a third piston position in which the top of said feed piston is substantially flush with the top of said feed cylinder.

4. The apparatus defined in claim 1 wherein the portion of said apparatus which is adapted to controllably yield in the vertical direction comprises said tram-like suspension means.

5. The apparatus defined in claim 1 wherein the portion of said apparatus which is adapted to controllably yield in the vertical direction comprises a portion of said carriage.

6. An apparatus for transporting particulate solids from an elevated solids feed reservoir and introducing said solids upwardly into a solids upflow vessel having a bottom solids inlet, said apparatus comprising:

a solids feed chute mounted adjacent to said solids upflow vessel and communicating with said feed reservoir for transporting solids from said feed reservoir by gravity flow, said feed chute terminating in a solids outlet in substantially the same horizontal plane as said bottom solids inlet and spaced from said solids inlet along a first horizontal axis;

a carriage positioned below said solids upflow vessel;

a single vertical solids feed cylinder mounted on said carriage;

a solids feed piston movably mounted in said feed cylinder;

piston actuating means suspended from said carriage for vertically reciprocating said solids feed piston between at least two piston positions along the axis of said feed cylinder;

first and second substantially horizontal structural rails mounted on opposite sides of said feed cylinder at a selected elevation below said horizontal plane and a substantial distance above the bottom of said piston actuating means, said first and second structural rails being substantially parallel to said first axis;

first and second wheel assemblies connected to opposite sides of said carriage and adapted to engage said first and second structural rails, respectively, so as to movably support said carriage, said feed cylinder and said piston actuating means from said rails;

carriage actuator means for horizontally reciprocating said carriage between a first stationary carriage position in which said feed cylinder is axially aligned with and immediately below said solids outlet and a second stationary carriage position in which said feed cylinder is axially aligned with and immediately below said bottom solids inlet;

solids sealing means mounted on said carriage for sealing said solids outlet and said bottom solids inlet when said feed cylinder is not axially aligned therewith;

control means for controlling the speed of movement of said carriage and said feed piston, for effecting the movement of said carriage between said first and second carriage positions while maintaining said feed piston stationary in a selected one of said piston positions, and for effecting the movement of said piston between said two or more piston positions while maintaining said carriage stationary in one of said carriage positions;

a foundation positioned below said carriage;

a wedge plate fixedly positioned upon said foundation;

wherein said carriage is adapted with a downwardly facing engaging surface positioned so as to be immediately above said wedge plate during the upward stroke of said feed piston and wherein at least a portion of the structure of said apparatus is adapted to controllably yield in the vertical direction under a preselected force during said upward stroke of said feed piston thereby engaging said engaging surface with said wedge plate and transmitting any force in excess of said preselected force directly to said foundation.

7. The apparatus defined in claim 6 wherein said piston actuating means is adapted to vertically reciprocate said feed piston among a lowermost first piston position in which the top of said feed piston is a preselected substantial distance below the top of said feed cylinder, an uppermost second piston position in which the top of said feed piston is a preselected distance above the top of said feed cylinder, and an intermediate third piston position in which the top of said feed piston is substantially flush with the top of said feed cylinder.

8. The apparatus defined in claim 6 wherein the portion of said apparatus which is adapted to controllably yield in the vertical direction comprises said first and second wheel assemblies.

9. The apparatus defined in claim 6 wherein the portion of said apparatus which is adapted to controllably yield in the vertical direction comprises a portion of said carriage.

10. An apparatus for transporting particulate solids from an elevated solids feed reservoir and introducing said solids into a solids upflow retort vessel having a bottom solids inlet, said apparatus comprising:

a single solids feed chute mounted adjacent to said retort vessel and communicating with an elevated solids feed reservoir for transporting solids from said feed reservoir by gravity flow, said feed chute terminating in a solids outlet in substantially the same horizontal plane as said bottom solids inlet and spaced from said solids inlet along a first horizontal axis;

a substantially fluid-tight housing below said retort vessel communicating with said feed chute through said solids outlet and communicating with said retort vessel through said bottom solids inlet, said housing defining a carriage enclosure having a roof, side walls and a floor;

a carriage positioned below said retort vessel within said carriage enclosure;

a single vertical solids feed cylinder mounted on said carriage;

a solids feed piston movably mounted in said feed cylinder;

a piston actuating hydraulic cylinder suspended from said carriage and having a shaft connected to said feed piston for vertically reciprocating said feed piston between at least two piston positions along the axis of said feed cylinder;

first and second substantially horizontal structural rails mounted within said carriage enclosure on opposite sides of said feed cylinder at a selected elevation below said horizontal plane and a substantial distance above said floor and above the bottom of said piston actuating hydraulic cylinder, said first and second structural rails being substantially parallel to said first axis;

first and second wheel assemblies connected to opposite sides of said carriage and adapted to engage said first and second structural rails, respectively, so as to movably support said carriage, said feed cylinder and said piston actuating hydraulic cylinder from said rails, each of said wheel assemblies comprising a plurality of pairs of wheels held in rollable engagement with the respective rail, the wheels of each pair being pivotally interconnected by wheel equalizing means and adjacent pairs of said wheels being pivotally interconnected by carriage equalizing means;

a carriage actuating hydraulic cylinder located exterior of said housing and having a shaft extending into said housing and connected to said carriage for reciprocating said carriage between a first stationary carriage position in which said feed cylinder is axially aligned with and immediately below said solids outlet and a second stationary carriage position in which said feed cylinder is axially aligned with and immediately below said bottom solids inlet;

first and second horizontal planar seal plates mounted on said carriage on opposite sides of said feed cylinder and adapted to be positioned in solids sealing relationship below said solids outlet and said bottom solids inlet, respectively, when said feed cylinder is not aligned therewith;

hydraulic fluid supply means operably connected to said carriage actuating hydraulic cylinder and to said piston actuating hydraulic cylinder;

piston position detecting means for detecting when said feed piston occupies each of said two or more piston positions;

carriage position detecting means for detecting when said carriage occupies each of said first and second carriage positions;

control means operably connected to said hydraulic fluid supply means, said piston position detecting means and said carriage position detecting means for controlling the speed of movement of said carriage and said feed piston, for effecting the movement of said carriage between said first and second carriage positions while maintaining said feed piston stationary in a selected one of said piston positions, and for effecting the movement of said piston between said two or more piston positions while maintaining said carriage stationary in one of said carriage positions; and a wedge plate supported by said floor of said housing; wherein said carriage is adapted with a downwardly facing engaging surface positioned so as to be immediately above said wedge plate during the upward stroke of said feed piston and wherein at least a portion of said carriage is adapted to controllably yield a preselected vertical distance during said upward stroke of said feed piston thereby engaging said engaging surface with said wedge plate and transmitting any force in excess of said preselected force directly to said floor.

11. The apparatus defined in claim 10 wherein said piston actuating hydraulic cylinder is adapted to vertically reciprocate said feed piston among a lowermost first piston position in which the top of said feed piston is a preselected substantial distance below the top of said feed cylinder, an uppermost second piston position in which the top of said feed piston is above the top of said feed cylinder and within an expanding inlet section of said retort vessel, and an intermediate third piston position in which the top of said feed piston is substantially flush with the top of said feed cylinder.

12. The apparatus defined in claim 10 wherein said engaging surface and the top surface of said wedge plate are inclined with respect to said horizontal plane at substantially the same angle and are adapted to engage one another during the upward stroke of said feed piston.

* * * * *